US010183838B2

(12) United States Patent
Weber et al.

(10) Patent No.: US 10,183,838 B2
(45) Date of Patent: Jan. 22, 2019

(54) FALL PREVENTION DEVICE FOR A PLATFORM

(71) Applicant: Inventio AG, Hergiswil (CH)

(72) Inventors: Stefan Weber, Niederwil (CH); Pascal Bläsi, Dierikon (CH)

(73) Assignee: INVENTIO AG, Hergiswil NW (CH)

( * ) Notice: Subject to any disclaimer, the term of this patent is extended or adjusted under 35 U.S.C. 154(b) by 365 days.

(21) Appl. No.: 14/903,702

(22) PCT Filed: Jul. 2, 2014

(86) PCT No.: PCT/EP2014/064028

§ 371 (c)(1),
(2) Date: Jan. 8, 2016

(87) PCT Pub. No.: WO2015/003964

PCT Pub. Date: Jan. 15, 2015

(65) Prior Publication Data

US 2016/0152442 A1 Jun. 2, 2016

(30) Foreign Application Priority Data

Jul. 10, 2013 (EP) ..... 13175972

(51) Int. Cl.
*B66B 5/18* (2006.01)
*B66B 19/00* (2006.01)

(52) U.S. Cl.
CPC ..... *B66B 5/18* (2013.01); *B66B 19/00* (2013.01); *B66B 19/005* (2013.01)

(58) Field of Classification Search
CPC ..... B66B 5/18; B66B 19/00; B66B 19/005
See application file for complete search history.

(56) References Cited

U.S. PATENT DOCUMENTS 1,886,213 A * 11/1932 Murphy ..... B66B 5/20 187/370
6,446,763 B1 * 9/2002 Glassey ..... B66B 19/007 187/414

(Continued)

FOREIGN PATENT DOCUMENTS

CN 101643164 A 2/2010
JP 2010037060 A 2/2010

(Continued)

*Primary Examiner* — Michael A Riegelman
(74) *Attorney, Agent, or Firm* — William J. Clemens; Shumaker, Loop & Kendrick, LLP

(57) ABSTRACT

A movable platform having a fall prevention device is arranged in a shaft of an elevator system and is operated by a corresponding method for securing the movable platform. The movable platform includes a complete machine room used in an expandable elevator for a building under construction. The movable platform can be moved vertically along guide rails. In order to secure the movable platform during movement, the fall prevention device includes at least one arresting device that is arranged on the movable platform and which can be brought into engagement with the guide rail if necessary. A locking element arranged on the movable platform interacts with a safety component arranged along the movement path, and can, if necessary, actuate the arresting device together with an arresting braking system of an elevator car attached to the movable platform, the locking element thus blocking a possible downward motion.

10 Claims, 6 Drawing Sheets

(56) References Cited

U.S. PATENT DOCUMENTS

| | | | | |
|---|---|---|---|---|
| 7,635,049 | B2 * | 12/2009 | Van Der Meijden | B66B 19/002 187/401 |
| 8,485,319 | B2 * | 7/2013 | Peacock | B66B 19/00 187/414 |
| 9,809,424 | B2 * | 11/2017 | Peacock | B66B 20/00 |
| 9,850,096 | B2 * | 12/2017 | Peacock | B66B 7/064 |
| 2007/0170014 | A1 * | 7/2007 | Woronoff | B66B 5/16 187/414 |
| 2012/0291395 | A1 * | 11/2012 | Plathin | B66B 19/00 52/741.1 |
| 2013/0233655 | A1 * | 9/2013 | Peacock | B66B 19/00 187/414 |
| 2013/0248299 | A1 * | 9/2013 | Perala | B66B 19/00 187/359 |
| 2015/0307322 | A1 * | 10/2015 | Peacock | B66B 7/064 187/254 |
| 2017/0050822 | A1 * | 2/2017 | Wurth | B66B 5/12 |
| 2017/0327348 | A1 * | 11/2017 | Blasi | B66B 19/005 |

FOREIGN PATENT DOCUMENTS

| | | | |
|---|---|---|---|
| JP | 2013112500 | A | 6/2013 |
| KR | 20020078342 | A | 10/2002 |
| WO | 0144096 | A1 | 6/2001 |
| WO | 2008059100 | A2 | 5/2008 |
| WO | 2008077992 | A1 | 7/2008 |
| WO | 2012072860 | A1 | 6/2012 |

* cited by examiner

FALL PREVENTION DEVICE FOR A PLATFORM

FIELD

The invention relates to a displaceable platform in an elevator installation with a fall prevention device and to a method for securing a displaceable platform in an elevator installation.

BACKGROUND

The elevator installation is usually installed in a building. For that purpose, the building includes a shaft which extends over several floors of the building. The elevator installation comprises at least one elevator car. The elevator car is moved by means of a drive along substantially vertical guide rails in the shaft. In the case of high buildings, lower regions of the building are already equipped with elevators while upper regions of the building are still under construction. In that case, use is made of special so-called concomitant-growth elevators. This means that during the construction time of the building an engine room of the elevator installation is displaced from a lower temporary use position to a next upper use position. The engine room is designed as a displaceable platform. In that case it is particularly important for the displaceable engine room or the displaceable platform to be safe during the displacement and not able to fall down.

A method is known from the publication WO 2012/072860 with regard to how an engine room of that kind can be displaced. In that respect, the displaceable engine room is secured, during displacement, by means of arresting devices from falling down. The arresting devices are in that case urged by springs into a blocking position. In this blocking position the arresting devices block downward movement and enable upward movement.

A temporary work platform, which is secured by means of a locking mechanism against falling down, is known from publication JP 2013-112500.

A further installation platform is known from the publication KR 2002-078342. In that case, a first brake device is activated by way of a pedal and a second brake device is activated by speed monitoring means.

SUMMARY

The invention has the object of providing an alternative fall prevention device at a displaceable platform of an elevator installation and a corresponding method for securing a displaceable platform in a shaft of an elevator installation. The fall prevention device shall be simple to operate and safe.

The displaceable platform is installed in the shaft of the elevator installation and is usually supported and held by deposit devices such as supports or rests at a wall of the shaft or in recesses in the wall of the shaft. The displaceable platform includes, for example, engine room equipment or the displaceable platform forms the engine room. The displaceable platform can obviously also be used for receiving or transporting other elevator components. At least one closure roof is usually disposed above the displaceable platform, at the end of the respective section of construction. The building can undergo further construction above the closure roof while an elevator is already in operation below the displaceable platform. The displaceable platform is preferably guided along vertically oriented guide rails.

These guide rails are fastened in the shaft and are provided for guidance of an elevator car of the elevator.

As soon as construction of a next-higher travel region in the building is finished, the guide rails can be installed by connection with the already-installed guide rails in the shaft. Further elevator components such as shaft doors, information transmitters, electrical wiring, etc., can be mounted. When the next-higher travel region is ready, the displaceable platform can be displaced so that this next-higher travel region or a corresponding part of the building can also be utilized by the elevator. Since the building is constructed from the bottom to the top, the displaceable platform is thus usually displaced from a lower temporary use position to an upper use position. The displacement of the displaceable platform to the upper use position is usually carried out by way of lifting means, for example by way of a chain block, crane, traction winch, hydraulic hoist or cable hoist. The displaceable platform or the displaceable engine room can obviously be displaced upwardly several times until reaching an uppermost use position or the final use position. The hoist for displacing the displaceable platform can act directly on the displaceable platform or can act on the displaceable platform by way of deflection means or by way of suspensions similarly to a block-and-tackle.

The displaceable platform is equipped, in accordance with the proposal, with a fall prevention device. The fall prevention device comprises on the one hand an arresting device, which is arranged at the displaceable platform and which can be brought into engagement with the guide rail, for example by means of an actuating device, when required. A safety component is preferably arranged along a displacement path of the displaceable platform. A locking mechanism arranged at the displaceable platform is in that case engaged with the safety component and the locking mechanism is connected at least indirectly with the arresting device. The locking mechanism is constructed so that it blocks or at least can block downward movement of the locking mechanism along the safety component. As a result, corresponding locking of the locking mechanism at the safety component takes place in the event of possible downward movement of the displaceable platform. As a consequence thereof a relative movement of the locking mechanism with respect to the displaceable platform occurs. The locking mechanism is in that regard so connected with the arresting device that in the case of relative movement of the locking mechanism with respect to the displaceable platform it brings the arresting device from a rest position into engagement with the guide rail. The locking mechanism together with the safety component forms the actuating device.

The displaceable platform can thus be displaced upwardly and in the case of unintended downward movement of the displaceable platform the arresting device is quickly and directly actuated at the displaceable platform. The displaceable platform is thus braked or stopped at the guide rails. In that case, use can be made of known arresting devices such as are also used for the braking of elevator cars.

The displaceable platform preferably has at least one suspension point with appropriate suspension means at which the car can be suspended when required so that the displaceable platform is displaceable together with the suspended car. In addition, an intermediate linkage, which connects a safety brake system—present in any case—of the car with the coupling linkage of the fall prevention device, is preferably provided. The safety brake system of the car is thus able to be actuated or brought into engagement with the guide rail substantially simultaneously with or even slightly ahead of the arresting device arranged at the displaceable platform. This is advantageous, since the arresting device of the displaceable platform or of the engine room can thereby be relieved of load.

The displaceable platform is preferably arranged to be vertically displaceable along mutually parallelly extending guide rails and the displaceable platform comprises at least two arresting devices. Each of the arresting devices co-operates with a respective one of the parallelly extending guide rails. The locking mechanism advantageously acts on the at least two arresting devices by way of a coupling linkage. The displaceable platform during an arresting process or during braking by the fall prevention device is thus symmetrically loaded and tipping moments can be kept small. Obviously, in the case of heavy displaceable platforms several pairs of arresting devices can also be connected together by way of the coupling linkage. In addition, several guide rails with several pairs of arresting devices can be used. Thus, for example, guide rails provided for later guidance of the elevator car and guide rails provided for later guidance of a counterweight can be used in order to guide and secure the displaceable platform. The several arresting devices for securing the displaceable platform can in that case be distributed to several guide rails. The several arresting devices are then connected together by way of the coupling linkage so that they are actuated synchronously.

The at least two arresting devices are preferably connected together by means of a connecting linkage so that they are actuable substantially together. The connecting linkage is in turn controlled by the coupling linkage. Controlled in this connection defines that the coupling linkage is coupled with the connecting linkage in such a way that actuation of the coupling linkage is transmitted to the connecting linkage. Alternatively, a connection of the at least two arresting devices by means of a cable pull or if need be also by means of electrical trigger means is obviously also possible. However, the connecting linkage is advantageous to produce and safe in use.

The coupling linkage preferably provides a translation which translates the relative movement between locking mechanism and displaceable platform so that an actuating travel until engagement of the arresting device with the guide rail is shortened. This is advantageous, since the travel path until possible standstill of the displaceable platform can be kept small.

Preferably, the coupling linkage is held in a standby position by means of a restoring spring. The standby position of the coupling linkage corresponds with the rest position of the arresting device, i.e. the displaceable platform is freely movable in upward direction and the arresting device is not in engagement with the guide rail. This is advantageous, since the displaceable platform is not blocked as a consequence of small vibrations.

The coupling linkage preferably includes stroke adjusting means and this stroke adjusting means can adjust the rest position of the arresting device. Thus, a required actuation travel from the rest position of the arresting device until engagement of the arresting device with the guide rail can be preset as required. This is advantageous, since response sensitivity of the fall prevention device can thereby be selectively set. Thus, for example, in the case of fine positioning in the upper use position the stroke adjustment can be set to coarse so as to enable slight lowering of the displaceable platform, whereas for displacement of the displaceable platform the stroke adjustment can be set to sensitive. Possible slipping down of the displaceable platform is thus rapidly stopped. Stroke adjustment to coarse in that case means that a longer actuating travel from the rest position of the arresting device until engagement of the arresting device for the guide rail is set. Stroke adjustment to sensitive in that case means that a shorter actuation travel from the rest position of the arresting device until engagement of the arresting device with the guide rail is set. The stroke adjusting means can include, for example, an eccentric disc by which, through turning, the actuation travel is set.

The locking mechanism is preferably constructed to be switchable so that a blocking function can be switched off at least temporarily. This is advantageous, since return travel of the displaceable platform in downward direction is thereby made possible. Temporary switching off in that case produces, for example, permanent manual intervention so that in the case of a fault the locking mechanism can block again solely through absence of the manual intervention.

The safety component is preferably a safety cable which runs at least along the displacement path of the displaceable platform and the locking mechanism is executed as a cable securing lock. The safety cable is guided by the locking mechanism or the locking mechanism engages around the safety cable. Safety-cable locking mechanisms are well-proven and economically available. The safety cable can in that case extend from the floor of the shaft to the respective uppermost use position or it can stretch only along the required displacement path of the displaceable platform.

Alternatively, the guide rail is at the same time the safety component. The locking mechanism is in that case constructed to co-operate with a web of the guide rail. This is particularly economic, since the guide rail present in any case is at the same time the safety component.

The fault prevention device is preferably provided with a warning device which notifies a rest position or standby position of the coupling linkage or of the arresting device. The warning device can be a switch which activates appropriate control displays or signal lights or it can also be, for example, a mechanical switching vane which indicates, for example, the position of the coupling linkage. The use of a warning device is advantageous, since locking of the locking mechanism or lowering of the displaceable platform can thereby also be rapidly indicated or detected optically. This increases safety. In the case of use of a switch with an appropriate control display or signal lights the circuit can operated with an energy store or with a battery during the time of displacement of the displaceable platform.

The displaceable platform preferably comprises deposit devices by means of which the displaceable platform can be fixed at predetermined places in the shaft. The deposit devices are, for example, supports or cantilever arms of the displaceable platform, which are extendible and which can be supported, for example, at the wall of the shaft or in recesses in the wall of the shaft. The displaceable platform preferably comprises at least one elevator drive which is used for driving the elevator with the at least one car. The displaceable platform is used as an engine room. The fall prevention device secures this displaceable platform together with the elevator drive against falling down at least during displacement of the displaceable platform from the lower temporary use position to the upper use position. This is obviously advantageous, since falling down of the elevator drive and possible significant consequences can be prevented.

In particular, a method for securing a displaceable platform in a shaft of an elevator installation is proposed. The displaceable platform is in that regard arranged to be vertically displaceable along the guide rail. The method comprises, in particular, the steps of:

arranging a safety component in the shaft of the elevator installation so that the safety component extends over at least an intended displacement path of the displaceable platform, coupling a locking mechanism, which is arranged at the displaceable platform, to the safety component, which locking mechanism is connected with an arresting device of the displaceable platform, setting the locking mechanism so that upward movement of the locking mechanism along the safety component is made possible and a downward movement of the locking mechanism along the safety component is blocked and actuating the arresting device of the displaceable platform as a consequence of relative movement between the locking mechanism and the displaceable platform in that the arresting device is brought from a rest position into engagement with the guide rail by the relative movement of the locking mechanism.

The displaceable platform can thus be safely displaced. Usual hoists, for example a building crane, can be used, since the displaceable platform is secured against slipping down or falling down by the equipment, which is arranged on the displaceable platform, at all times during the displacement.

The car of the elevator installation during displacement of the engine room, which is arranged on the displaceable platform, of the elevator installation from a lower temporary use position to a next-upper use position is preferably temporarily suspended at the displaceable platform. Moreover, the safety brake system of the car is preferably connected with the locking mechanism so that in the case of actuation of the locking mechanism the safety brake system of the car is actuated together with the arresting device arranged at the displaceable platform.

The performance requirement of the arresting device of the displaceable platform can thereby be reduced, since the weight of the car itself is accepted by the safety brake system of the car.

The method preferably makes possible manual deactivation of the blocking function of the locking mechanism or the connection thereof with the arresting device so that the displaceable platform can be lowered at least over a predetermined deposit travel without bringing the arresting device into engagement with the guide rail.

In a special embodiment, the equipment of a displaceable engine room includes a multi-stage displacement, transportation and security system. In that case, a closure roof is disposed at the very top or at the upper end of the respective building section. This closure roof is mounted at the upper shaft end by a contractor at the time of finishing the respective building section. The closure roof has, on the one hand, the task of separating the lower shaft region from the building region lying above the closure roof and protecting the elevator installation which is in operation in the lower region of the building. In addition, it preferably includes support structures or suspension eyes or points. An auxiliary engineering platform is disposed below the closure roof. This auxiliary engineering platform has a load-bearing structure which, similarly to the displaceable platform, comprises rest or supports which enable supporting of the auxiliary engineering platform in recesses of the shaft walls. A load-bearing structure additionally comprises guide rollers which can guide the auxiliary engineering platform in the shaft, for example at walls of the shaft.

The auxiliary engineering platform preferably comprises a first hoist, for example a cable lifting device, which is provided in order to pull itself and thus the auxiliary engineering platform up in the shaft in co-operation with the supporting structure of the closure roof. In addition, the auxiliary engineering platform preferably also comprises a cable lock which can prevent possible slipping down of the auxiliary platform. The cable lock acts on a cable which is similarly connected with the closure roof, usually by means of a support roller. After installation or displacement of the closure roof the auxiliary engineering platform can thus be raised and fixed in the shaft in the vicinity of the closure roof.

The auxiliary engineering platform preferably now includes further support points or fastening points at which an assembly platform or other auxiliary hoists can be suspended. By means of the assembly platform and possible further auxiliary hoists the guide rails can be subsequently installed at the guide rails, which are disposed further below and already installed, in the shaft. In addition, further shaft material can be fitted by means of the assembly platform or by means of other auxiliary hoists. Operation of the elevator installation travelling in the lower shaft region is in that case not disturbed. For preference, marks which can be used as alignment aids for precise alignment of the guide rails are applied to the auxiliary engineering platform. These marks can be alignment marks for the fastening of plumb lines or for placement of laser instruments or the like.

The auxiliary engineering platform now preferably additionally includes a second hoist, for example a chain block. The chain block is designed so that the displaceable platform or engine room can preferably be displaced together with the suspended car.

The use of an auxiliary engineering platform of that kind is advantageous, since:

the closure roof can be of simple design, because it merely has to comprise the support structure for displacement of the auxiliary engineering platform and since it merely has to be designed in order to carry the auxiliary engineering platform, the auxiliary engineering platform can include or carry devices required for installation of the shaft equipment and for displacement of the displaceable platform, as a result of which further space on the actual displaceable platform is not needed, and the auxiliary engineering platform can be removed after completion of the building and possibly re-used in other buildings.

DESCRIPTION OF THE DRAWINGS

Embodiments of the invention are described by way of example in the following on the basis of partly schematic figures. Equivalent parts are provided in the figures with the same reference numerals.

DETAILED DESCRIPTION

Figure 1:
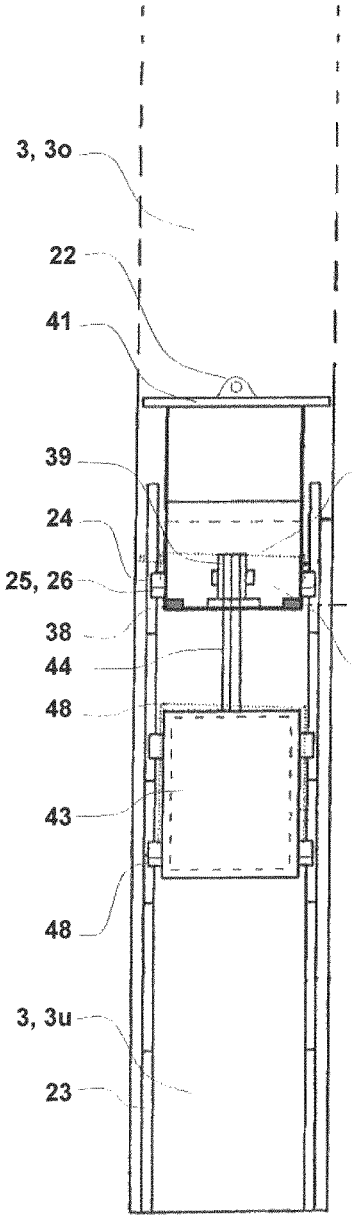
FIG. 1 shows a schematic detail of an elevator with a displaceable platform in a lower temporary use position.

In FIG. 1 an elevator installation is installed in a building. The building is substantially completed in a lower region 3*u* and the elevator installation utilizes this lower region 3*u*. The elevator installation comprises an elevator car 43. The elevator car 43 is moved by means of a drive 39 and by way of supporting and drive means 44 along substantially vertical guide rails 23 in a shaft 3 of the building. The drive 39 is arranged on a displaceable platform 20. The displaceable platform 20 is thus also termed displaceable engine room. In FIG. 1 the displaceable platform 20 is arranged in a lower temporary use position P1. It is fixed by means of, for example, a deposit device 38 to or in walls of the shaft, in the example in front and rear walls. The deposit devices 38 are preferably rests or supports which can be moved out. These deposit devices are guided in a cavity of the displaceable platform 20 to be longitudinally displaceable. These deposit devices can be drawn out in a front region of the displaceable platform 20 so that they overlap a floor. In the rear region of the displaceable platform 20 these deposit devices can be pushed rearwardly from the front so that they protrude into niches or recesses of the rear wall. Thus, the deposit devices 38 can be actuated without walking on the displaceable platform 20. Obviously, use can also be made of lateral niches, recesses, wall projections or support brackets, wherein then the deposit devices would be laterally moved out or pivoted out.

The displaceable platform 20 includes the essential elevator components required for operation of the elevator installation insofar as they are usually arranged in the engine room. The elevator installation can thus be operated in the lower region 3*u* of the shaft 3. The displaceable platform 20 schematically shown in FIG. 1 additionally has a protective roof 41. The protective roof 41 closes off the shaft 3 in upward direction. Independently thereof, further roofs or a closure roof are usually mounted by parties responsible for construction so as to avoid, for example, penetration of concrete or rainwater, etc., into the lower shaft region 3*u*.

The elevator car 43 obviously also includes an own safety brake or safety brake system 48, which arrests or stops the elevator car 43 in known mode and manner in the event of excess speed. In addition, the displaceable platform 20 is equipped with a fall prevention device 25. In FIG. 1 this fall prevention device 25 is not of principal significance, since the displaceable platform 20 is fixed and blocked by the deposit device 38 and thus cannot fall down.

Figure 2:
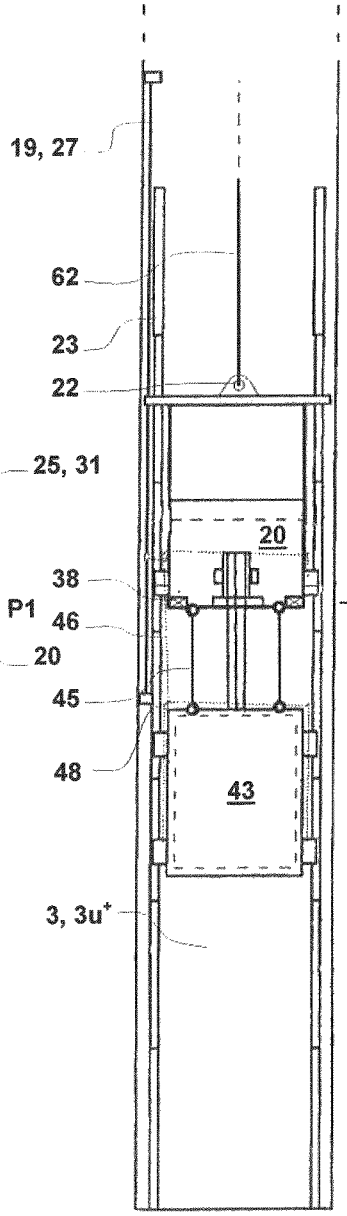
FIG. 2 shows the elevator of FIG. 1 in a readiness setting for displacement of the displaceable platform to an upper use position.

In FIG. 2 the building is completed as far as a next region 3*u*$^+$. The guide rails 23 and obviously also further shaft materials such as shaft doors or information systems, etc., which are not illustrated, are installed. A safety component 27 of the fall prevention device 25, in the example a safety cable 27*a*, is installed above the next region 3*u*$^+$. A detailed construction of one possible embodiment of the fall prevention device 25 is explained later.

The elevator car 43 is suspended at the displaceable platform 20 by way of suspension means, in the example by way of support rods 45. For that purpose, the displaceable platform is provided with appropriate suspension points. A possible counterweight (not illustrated) is fixed to the lower end of the shaft 3. Depending on the form of suspension, the support means 44 can be detached or at least relieved of load at one of the support means fastening points and can, in the subsequent pulling up of the displaceable platform 20 or in a later work step, simply be pulled afterwards or at the same time. The displaceable platform 20 or the entire engine room can now be raised together with the elevator car 43 by way of a hoist 62, which is suspended at a suspension point 22 of the displaceable platform 20, and moved to an upper use position P2. The upper use position P2 is defined in such a way that a next-higher travel region in the building can be serviced. In order to displace the displaceable platform 20, obviously the deposit device 38 of the displaceable platform 20 is released or retracted so that it does not obstruct displacement of the displaceable platform 20. During the raising and movement, the displaceable platform 20 is secured by means of the fall prevention device 25 against unexpected downward movement. The fall prevention device 25 of the displaceable platform 20 is in that case coupled with the safety brake system 48 of the elevator car 43 by means of an intermediate linkage 46. Thus, in the event of possible slipping down of the displaceable platform 20 with suspended cage car 43 the fall prevention device 25 of the displaceable platform 20 and the safety brake system 48 of the elevator car are directly brought into action. The safety brake system 48 of the elevator car 43 thus acts as a component of the fall prevention device.

Figure 3:
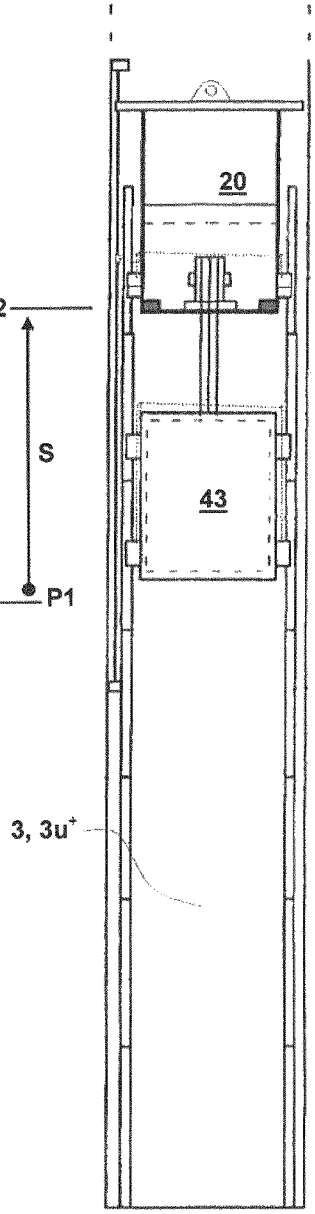
FIG. 3 shows the elevator of FIGS. 1 and 2 after displacement of the displaceable platform to an upper use position.

As soon as the upper use position P2, as apparent in FIG. 3, is reached, the deposit device 38 of the displaceable platform 20 is moved out again and the displaceable platform 20 is deposited on the deposit device 38 and fixed by this. The support means 44 can be reconnected—obviously in a length adapted to the new travel range—with the car 43 and the possible counterweight (not illustrated) and/or fixed at the support means fastening points. The suspension means 44 or the support rods 45, by means of which the elevator car 43 was suspended at the displaceable platform 20, can be removed. At the same time, obviously also the intermediate linkage 46 is released or decoupled from the safety brake system 48 of the elevator car 43. The elevator installation is thus available in a short time for the extended travel range.

Figure 4:
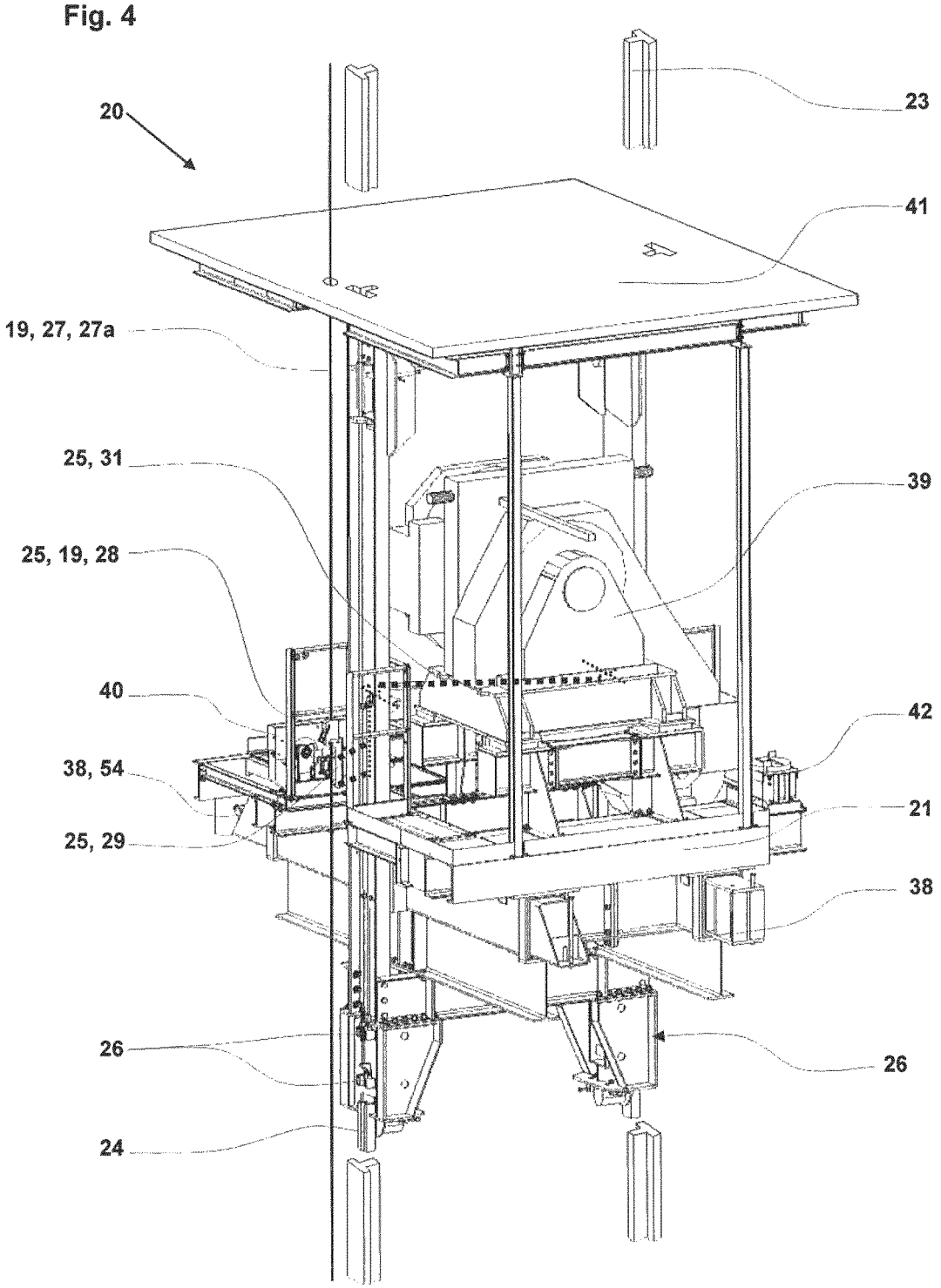
FIG. 4 shows a displaceable platform with engine room equipment.

An embodiment of the displaceable platform 20 is illustrated in FIG. 4. The displaceable platform 20 includes a support structure 21. The components corresponding with the purpose of the displaceable platform 20 are arranged on the support structure 21. In the example, the displaceable platform 20 comprises engine room components such as required for operation of the elevator installation. Those are, in particular, the drive 39 together with appropriate electrical control elements such as elevator control and inverter or converter, a speed limiter 40 for activating the safety brake system 48 of the elevator car 43, or a support means fastening point 42. The list is only by way of example. The purpose for which a displaceable platform 20 is needed obviously determines the fitting out of the displaceable platform. The deposit device 38 is integrated in the support structure 21. These are support beams or supports, which are guided in the support structure 21 and which can be moved out for setting down the displaceable platform 20. Control rods 54, which enable operation of rearwardly disposed deposit devices 38, are provided for moving out or retracting the deposit device 38. This means that the deposit devices 38 can be directly manually operated from a front side, which is, for example, accessible from a floor of the building, whilst deposit devices 38 on the opposite side, thus rearwardly disposed, are operated by way of control rods 54. The support structure 21 includes guide shoes 24 by which the displaceable platform 20 can be guided along the guide rails 23. The entire displaceable platform 20 is covered by a protective roof 41. The protective roof 41 has openings which make possible at least a passage of the guide rails 23, the safety cable 27*a* and also the hoist by which the displaceable platform 20 can be drawn up.

Figure 5:
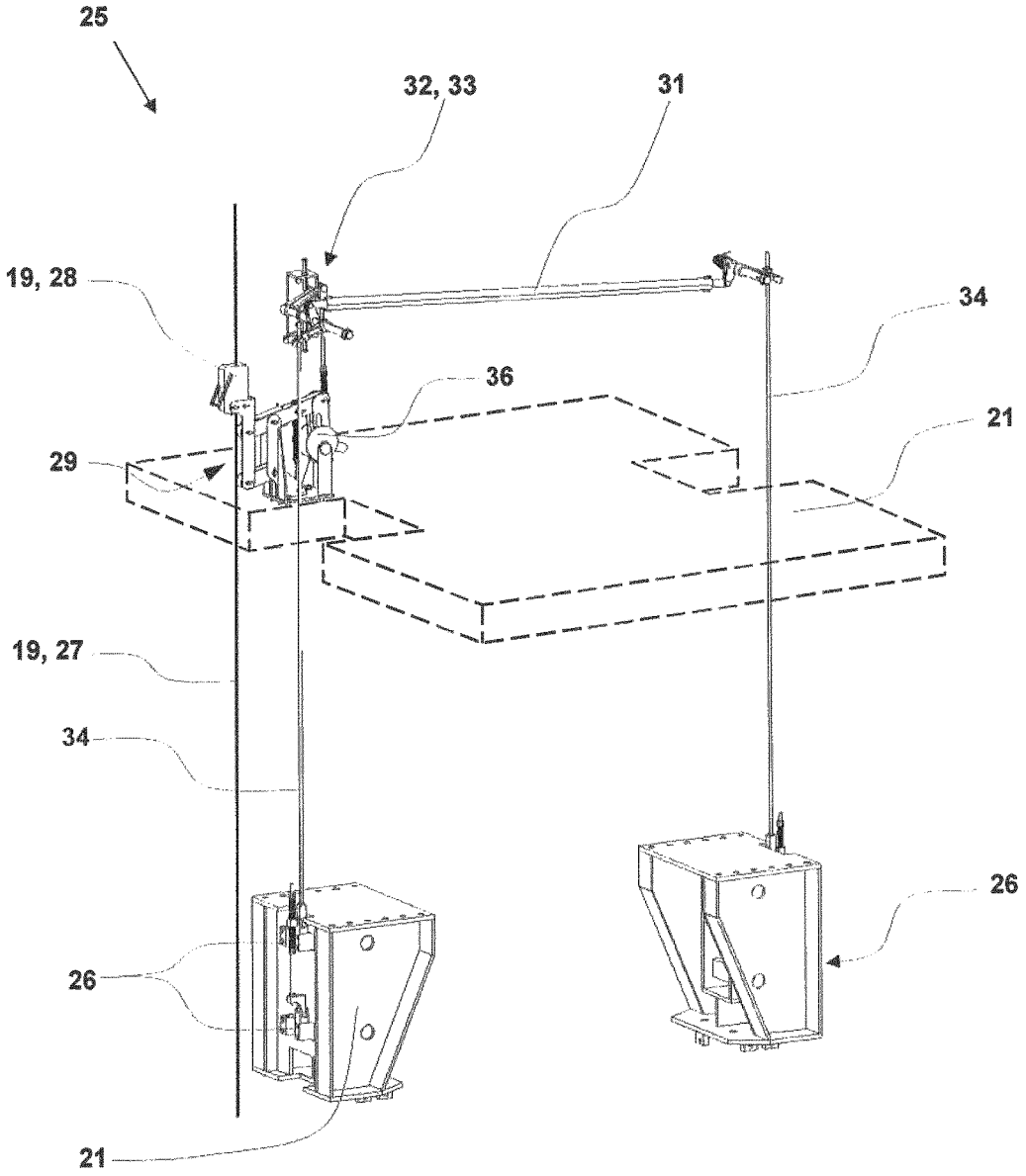
FIG. 5 shows a fall prevention device at a displaceable platform.

The fall prevention device 25 of the displaceable platform 20 is largely integrated in the support structure 21. For that purpose, in the present example two pairs of arresting devices 26, which together with the guide rail 23 can stop and hold the displaceable platform 20 with the associated loads, are integrated in the support structure. The arresting devices 26 are, as illustrated in detail in FIGS. 5 and 6, connected with a pull-rod lever 33 by way of pull rods 34. The pull-rod levers 33 are in addition synchronized with one another by way of a connecting rod 31 and appropriate lever connections 32. Thus, the arresting devices 26 arranged on either side of the displaceable platform 20 are in every case actuated together and thus blocking on one side is precluded. The lever connections 32 are activated by a coupling linkage 29 and the coupling linkage 29 is coupled with an actuating device 19. In the example, a locking mechanism 28 is used for that purpose and is coupled with the safety cable 27. The locking mechanism 28 is preferably a proprietary locking mechanism. If required, these locking mechanisms can be switched over so that blocking is at least temporarily cancelled.

The locking mechanism 28 controls the arresting device 26 by way of the coupling linkage 29 and in the usual case also the safety brake system 48 of the elevator car 43 by way of the intermediate linkage 46. A form of embodiment of the coupling linkage 29 is illustrated in detail in FIG. 6. The coupling linkage includes a lever support 29.3. The lever support 29.3 has fastenings which enable fastening of the coupling linkage to the platform structure 21. Two parallel levers 29.2 are mounted in the lever support 29.3 and these two parallel levers 29.2 have a connector 29.1 at one end. A pivot movement of the connector parallel to the safety component 27 or the corresponding safety cable is made possible by means of the parallel levers 29.2 and the connector 29.1 as well as the mounting thereof in the lever support 29.3. The locking means 28 is fastened to the connector 29.1 so that it is aligned substantially in correspondence with the path of the safety cable 27. The parallel levers 29.2 are urged by means of a restoring spring 30 into a standby position. One of the parallel levers 29.2 is connected by way of a bearing point and a first rod with a pull-rod lever 33, with a connecting linkage 31 and a further pull-rod lever 33. The first rod—29.4—is connected by way of compensating springs with the parallel levers 29.2 so that reaction forces from the arresting devices 26 on the coupling linkage 29 are limited. The arresting devices 26 are connected with the pull-rod levers 33 by way of pull rods 34. Thus, when the displaceable platform 20 moves downwards, the locking mechanism 28 locks at the safety component 27. The parallel levers 29.2 are thereby pivoted and these accordingly pivot the pull-rod levers 33, which then actuate the arresting device 26 by way of the pull rods 34.

Figure 6:
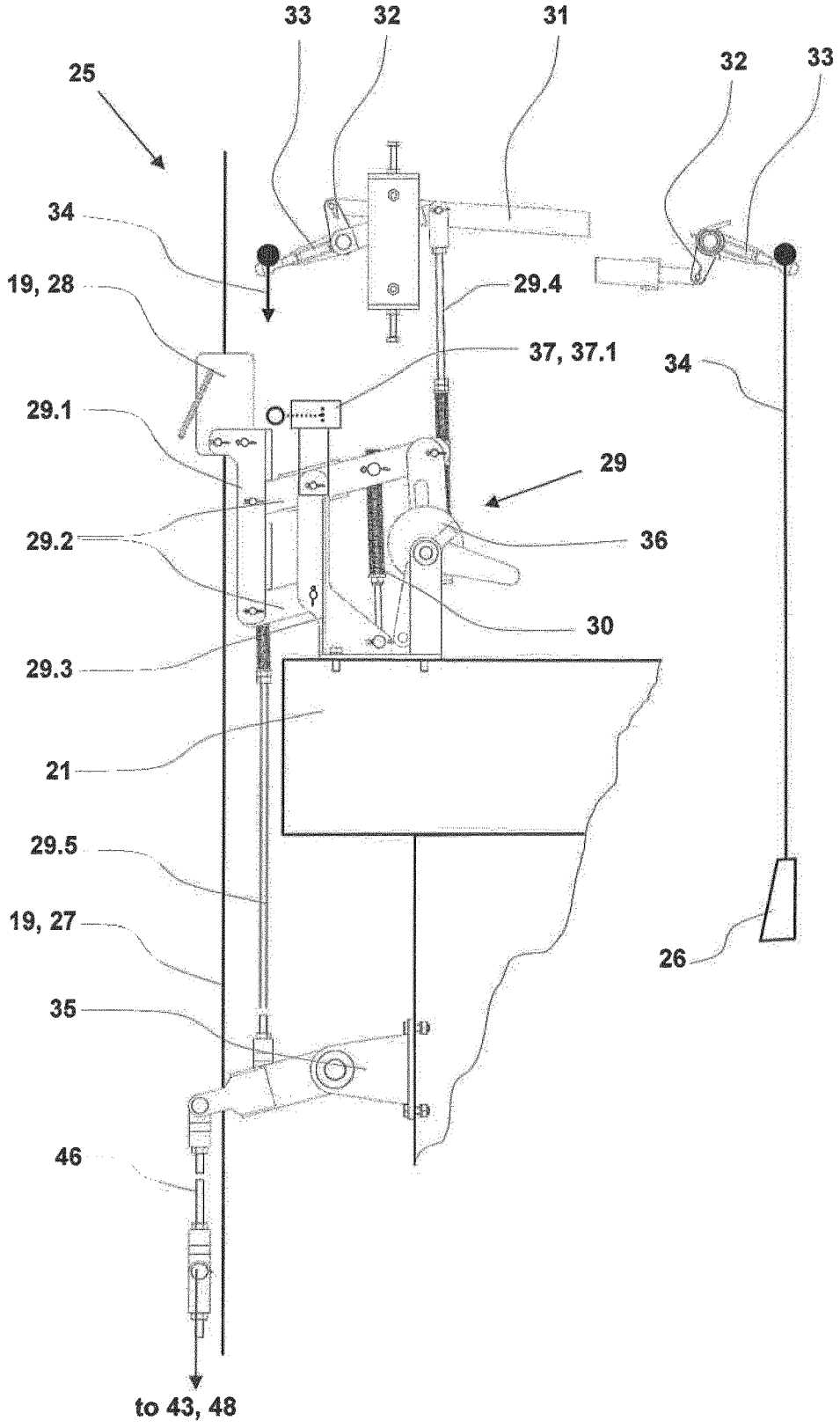
FIG. 6 shows a detail of the fall prevention device of FIG. 5.

In the embodiment according to FIG. 6, one of the parallel levers 29.2 additionally activates a second rod 29.5. This second rod 29.5 is led to translation means 35. A movement of the parallel lever 29.2 is thus transmitted directly to the translation means 35, which then activates the intermediate linkage 46, which in turn actuates the safety brake system 48 of the elevator car 43. The translation means is constructed so that it amplifies the movement of the parallel lever 29.2 so that the safety brake system 48 of the elevator car 43 comes into action at approximately the same time or slightly ahead of the arresting devices 26 of the displaceable platform 20. The second lever 29.5 is in that case similarly connected with the parallel levers 29.2 by way of compensating springs so that compensation can be provided for non-uniformities of movement between the different arresting and safety brake systems.

In addition, the coupling linkage 29 includes stroke adjustment means 36. This is an eccentric disc by means of which the parallel levers 29.2 can be so displaced that the arresting devices 26 are already lifted out of their standby position. A response sensitivity of the fall prevention device can thus be set, since a residual actuation path in the case of a required actuation can be shortened. In addition, arranged at the coupling linkage 29 is an electrical contact 37.1 which on actuation of the parallel levers 29.2—and thus corresponding actuation of the arresting and braking systems—switches a warning device 37, for example a warning light or a flashing beacon. An accumulator or a battery is carried on the displaceable platform for energy supply.

Figure 7:
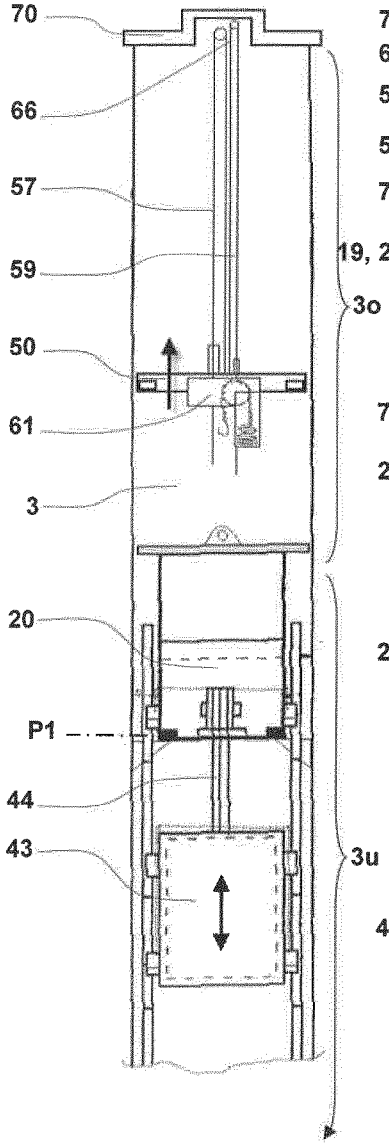
FIG. 7 shows a schematic overall view of a displaceable elevator in a lower temporary use position.
Figure 8:
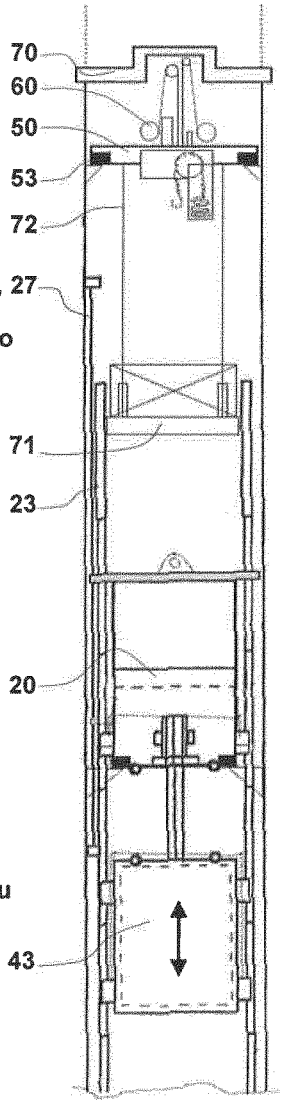
FIG. 8 shows the displaceable elevator of FIG. 7 at the time of equipping an upper travel region of the elevator.

An example of a displacement cycle of a conjunctively growing elevator installation is explained by way of example on the basis of FIGS. 7 and 8. In FIG. 7 the elevator installation is in operation in a lower region 3*u* of the shaft 3. The displaceable platform 20 is, as an engine room, fixed at the upper end of the lower region 3*u*. The elevator car 43 is disposed in normal operation. Construction of the building above an upper region 3*o* has been continued by the contractor and the contractor has mounted a closure roof 70 at the upper end of the upper region 3*o*. The closure roof 70 closes the entire shaft 3 in upward direction so that no objects can fall into the shaft 3. Suspension eyes at which a suspension device 66 is suspended are anchored in the closure roof 70. An auxiliary engineering platform 50, which is connected with the suspension device 66 by way of cables 57, 59, is installed in the upper region 3*o* of the shaft.

Figure 10:
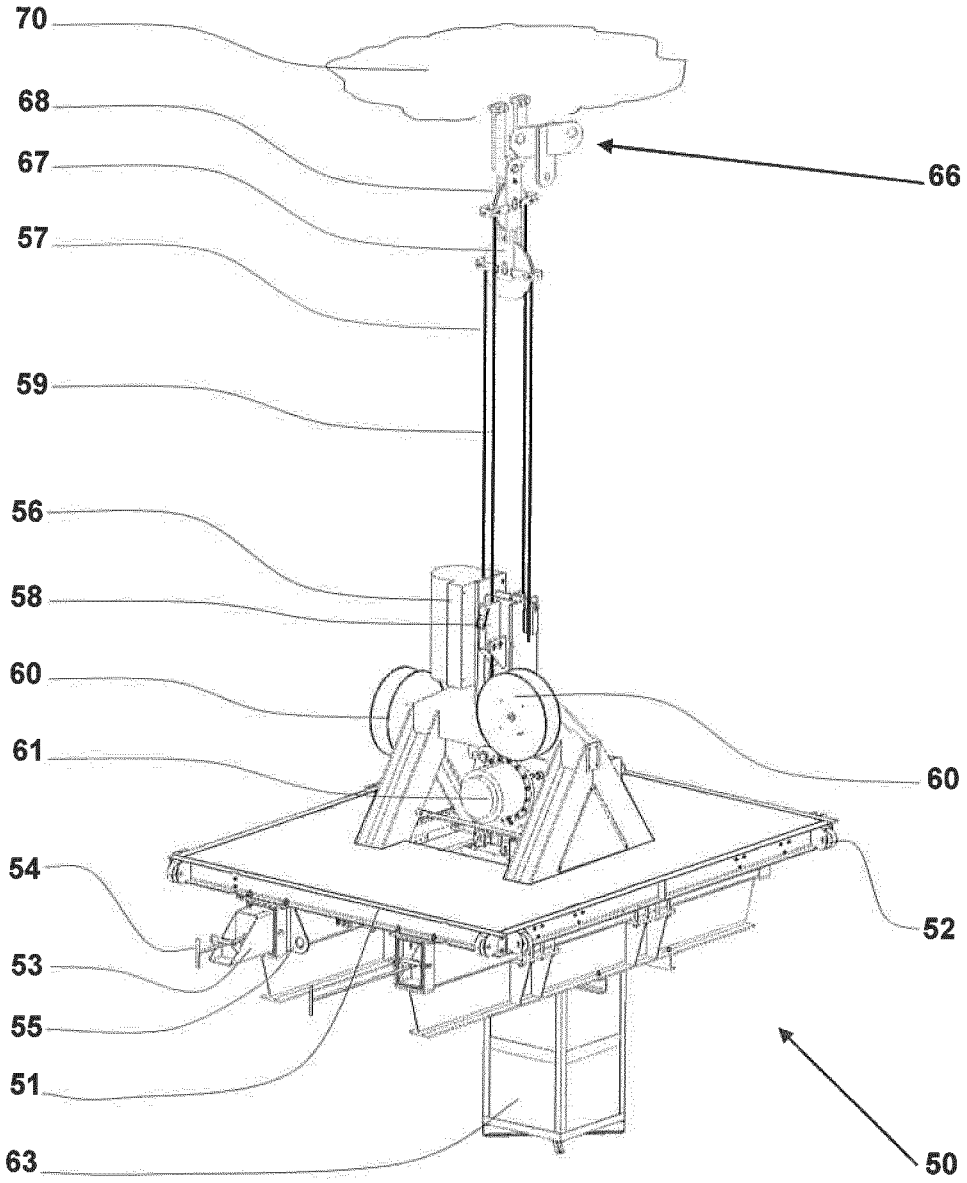

The auxiliary engineering platform 50 is illustrated in detail in FIG. 10. The auxiliary engineering platform 50 has a support structure 51 which, similarly to the displaceable platform 20, comprises rests or supports 53 which enable support of the auxiliary engineering platform 50 in recesses of the shaft walls. The rests or supports 53 can, as in the case of the embodiment explained in connection with the deposit device 38 of the displaceable platform 20, be actuated by control rods 54. The support structure 51 additionally comprises guide rollers 52 which can guide the auxiliary engineering platform 50 in the shaft 3.

The auxiliary engineering platform 50 is fixed on each occasion in the uppermost region near the closure roof. It includes aids which enable displacement of the auxiliary engineering platform itself as well as later raising of the displaceable platform 20. In addition, the auxiliary engineering platform 50 has further support points which are used in order to finish off the shaft with shaft material required for operation of the elevator installation. A first hoist 56 in the form of a cable pull device is arranged on the auxiliary engineering platform 50. The first hoist 56 acts on a cable 57. The cable 57 is fastened at one end to the auxiliary engineering platform, is guided by way of a support roller 67 arranged at the suspension device 66 anchored in the closure roof 70, and is led to the first hoist 56 or through drive elements of the first hoist 56. The first hoist 56 thus draws itself and thereby the entire auxiliary engineering platform 50 at the cable 57 in upward direction. In addition, an auxiliary locking mechanism 58 which prevents possible slipping down of the auxiliary platform is also arranged on the auxiliary engineering platform 50. The auxiliary locking mechanism 58 acts on a further cable 59, which is similarly connected by way of a support roller 68 with the closure roof 70 and is fixed by one end to the auxiliary engineering platform 50. The auxiliary locking mechanism 58 is designed to be able to hold, together with the further cable 59, the auxiliary engineering platform 50. In addition, cable winches 60 are provided and serve for winding up the cables 57, 59 when the auxiliary engineering platform is fixed by means of the supports 53. The suspensions and the arrangements of the guides 52 are selected so that the auxiliary engineering platform 50 can be moved substantially horizontally.

The auxiliary engineering platform 50 has further support points 55 at which an assembly platform 71 (see FIG. 8) or other auxiliary hoists can be suspended. In addition, the auxiliary engineering platform 50 comprises a second motorized hoist 61, for example a chain block. The chain block is designed so that the displaceable platform or the engine room can be displaced, preferably together with the suspended car. Moreover, arranged at the auxiliary engineering platform 50 is a chain container 63 serving for reception of the chain of the second motorized hoist 61.

In FIG. 7 it is now apparent how the auxiliary engineering platform 50 is moved upwardly. The ends of the cables 57, 59 are drawn through the first hoist 56 or guided through the auxiliary locking mechanism 58. If need be, the ends of the cables 57, 59 are weighted by weights so as to ensure tightening of the cables with certainty. After the auxiliary engineering platform 50 has been pulled up this is fixed near the closure roof 70 (see FIG. 8) by means of the supports 53. Moreover, the cables 57, 59 are relieved of load and wound up on the cable winches 60.

The assembly platform 71 is now suspended at the auxiliary engineering platform 50 by way of associated support means 72. By means of the assembly platform 71 and, possible further auxiliary hoists the guide rails 23 can now be installed in the shaft in connection with the already installed guide rails lying further down. In addition, further shaft material can be fitted. Operation of the elevator installation travelling in the lower shaft region 3*u* is not disturbed during these activities. Marks (not shown) which can be used as alignment aids in precise orientation of the guide rails 23 are applied to the auxiliary engineering platform.

Figure 9:
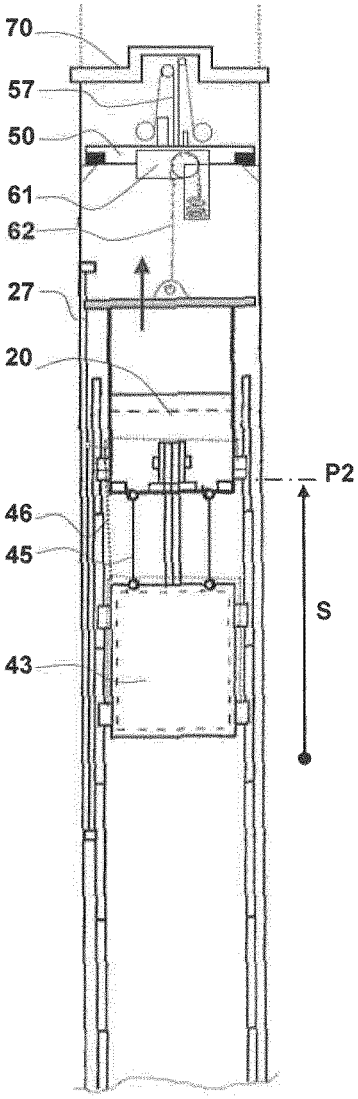
FIG. 9 shows the displaceable elevator of FIGS. 7 and 8 at the time of displacement to the upper use position and FIG. 10 shows an auxiliary engineering platform used for displacement of the displaceable platform.

After the conclusion of the installation operations in the corresponding shaft region, the assembly platform 71 can be removed or it can also be parked on the protective roof 41 of the displaceable platform. As apparent in FIG. 9, the composite of displaceable platform 20 and elevator car 43 is then displaced from the lower temporary use position P1 to the upper use position P2 by means of a second motorized hoist 61 or the chain block, which is shown in the example, and the associated chain 62. Securing and preparation of the displaceable platform 20 and the elevator car 43 are then carried out as illustrated in connection with the embodiments with respect to FIGS. 1 to 3. The building can thus grow in steps and the elevator can be expanded on each occasion by predetermined expansion steps S. The expansion steps S can take place from floor to floor. However, expansion steps S in the range of 15 to 50 meters are usually selected.

The expert will recognize further embodiments. Thus, the expert can also use hydraulic jacks or traction devices instead of the illustrated chain block.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A displaceable platform positioned in a shaft of an elevator installation with a fall prevention device, wherein the shaft includes a guide rail and the displaceable platform is vertically displaceable along the guide rail, the displaceable platform including at least one suspension point at which an elevator car is suspended so that the displaceable platform is displaceable together with the suspended car, the fall prevention device comprising:

at least one arresting device arranged at the displaceable platform and which can be brought into engagement with the guide rail;

an intermediate linkage connecting a safety brake system of the car with a coupling linkage of the displaceable platform so that the safety brake system of the car can be brought into engagement with the guide rail substantially simultaneously with or slightly before the at least one arresting device is brought into engagement with the guide rail;

a safety component arranged along a displacement path of the displaceable platform;

a locking mechanism arranged at the displaceable platform and which is engaged with the safety component and connected at least indirectly with the at least one arresting device;

the locking mechanism blocks a downward movement along the safety component, wherein when downward movement of the displaceable platform and corresponding locking of the locking mechanism occur a relative movement of the locking mechanism with respect to the displaceable platform takes place; and wherein the locking mechanism is connected with the at least one arresting device to bring the at least one arresting device from a rest position into engagement with the guide rail when relative movement of the locking mechanism with respect to the displaceable platform occurs.

2. The displaceable platform according to claim 1, wherein the displaceable platform is vertically displaceable along two mutually parallelly extending guide rails and comprises at least two arresting devices, wherein each of the arresting devices co-operates with a respective one of the guide rails, wherein the locking mechanism acts by the coupling linkage on the at least two arresting devices of the displaceable platform, and wherein the locking mechanism acts on the safety brake system of the car by the intermediate linkage connected with the coupling linkage.

3. The displaceable platform according to claim 2 wherein the at least two arresting devices of the displaceable platform are connected together by a connecting linkage to be actuable substantially together and the connecting linkage is controlled by the coupling linkage.

4. The displaceable platform according to claim 2 wherein the coupling linkage has a translation which translates relative movement between the locking mechanism and the displaceable platform so that an actuating travel until engagement of the at least two arresting devices of the displaceable platform and of the safety brake system of the car with the guide rails is shortened.

5. The displaceable platform according to claim 2 wherein the coupling linkage is held in a standby position by a restoring spring, wherein the standby position of the coupling linkage corresponds with the rest position of the at least two arresting devices.

6. The displaceable platform according to claim 2 wherein the coupling linkage includes stroke adjustment means and the stroke adjustment means adjusts the rest position of the at least two arresting devices so that a required actuation travel from the rest position of the at least two arresting devices until engagement of the at least two arresting devices with the guide rails can be preset.

7. The displaceable platform according to claim 1 wherein the locking mechanism is switchable so that a locking function can be switched off at least temporarily.

8. The displaceable platform according to claim 1 wherein the safety component is a safety cable that runs over at least a displacement path of the displaceable platform and the locking mechanism is a cable securing lock that engages around the safety cable, or wherein the safety component is the guide rail that is used at the same time for guidance of the displaceable platform and the locking mechanism cooperates with a web of the guide rail.

9. The displaceable platform according to claim 1 wherein the fall prevention device includes a warning device that makes the rest position or a standby position of the coupling linkage recognizable.

10. The displaceable platform according to claim 1 wherein the displaceable platform includes deposit devices for fixing the displaceable platform at predetermined places in the shaft, an elevator drive used for driving the car, and wherein the fall prevention device secures the displaceable platform against falling at least during displacement of the displaceable platform from a lower, temporary use position to an upper use position in the shaft.

* * * * *